US007251839B2

(12) United States Patent
Bell

(10) Patent No.: US 7,251,839 B2
(45) Date of Patent: Aug. 7, 2007

(54) CLEANING MITT

(75) Inventor: Brian Kenneth Bell, Cinnaminson, NJ (US)

(73) Assignee: Quickie Manufacturing Company, Cinnaminson, NJ (US)

( * ) Notice: Subject to any disclaimer, the term of this patent is extended or adjusted under 35 U.S.C. 154(b) by 0 days.

(21) Appl. No.: 11/304,469

(22) Filed: Dec. 15, 2005

(65) Prior Publication Data

US 2007/0136925 A1 Jun. 21, 2007

(51) Int. Cl.
*A41D 19/00* (2006.01)

(52) U.S. Cl. ..... 2/161.6; 2/163; 15/227

(58) Field of Classification Search ..... 2/16, 2/161.1, 161.6, 163; 15/227
See application file for complete search history.

(56) References Cited

U.S. PATENT DOCUMENTS 2,643,388 A * 6/1953 Scott ..... 2/158
2,884,644 A * 5/1959 Jefferson ..... 2/158
3,683,420 A * 8/1972 Vilain ..... 2/161.7
D258,625 S 3/1981 Sheridan
D264,893 S 6/1982 Schroeder
4,534,066 A * 8/1985 Hansson ..... 2/163
D288,142 S 2/1987 Gregg
4,752,973 A * 6/1988 Wolfberg et al. ..... 2/163
4,884,374 A 12/1989 Natale et al.
5,016,286 A * 5/1991 Henriksen ..... 2/161.6
D381,130 S 7/1997 Anderson
5,708,980 A * 1/1998 LaManna et al. ..... 2/163
5,829,089 A * 11/1998 Steadman ..... 15/227
D441,920 S 5/2001 Fleishhacker
6,279,165 B1 * 8/2001 Kobayashi ..... 2/163
D468,871 S 1/2003 Roach et al.
6,530,108 B1 * 3/2003 Brown et al. ..... 15/227
6,560,813 B2 * 5/2003 Brown et al. ..... 15/227
D488,285 S * 4/2004 Ponzini ..... D2/622
6,829,802 B2 * 12/2004 McKenzie ..... 15/227
2002/0000017 A1 1/2002 Brown
2002/0010957 A1 * 1/2002 Katz ..... 2/161.7
2005/0229349 A1 * 10/2005 Foser ..... 15/227

OTHER PUBLICATIONS www.3m.com website, Scotch Brite Dusting Cloths and Mitts (2 pages).

(Continued)

*Primary Examiner*—Katherine Moran
(74) *Attorney, Agent, or Firm*—Wildman, Harrold, Allen & Dixon, LLP

(57) ABSTRACT

The invention relates to cleaning mitts, and methods for their use. In one embodiment, a mitt under the invention may be made of microfiber material, and may be defined by a hand-receiving section, a separate thumb-receiving section, a separate index-finger receiving section, and a separate three-finger receiving section. In another embodiment, a mitt under the invention may have an elastic section defining an opening in the mitt for insertion of a user's hand. In a further embodiment, for a method of using a mitt to clean under the invention, a microfiber mitt may be provided, a user may insert a hand into the mitt, and the mitt may be used to clean a surface. The microfiber material of the mitt may allow the surface to be dusted when the mitt is dry and/or cleaned when the mitt is damp.

50 Claims, 2 Drawing Sheets

OTHER PUBLICATIONS www.amazingcloth.com website, Microfiber Mitts & Dusters (1 page).
www.amazingcloth.com website, Microfiber Cleaning "BIG" Mitt (1 page).
www.amazingcloth.com website, Microfiber Cleaning "Fluffy" Mitt (1 page).
www.casabella.com website, Microfiber Kitchen Cleaning Mitts (1 page).

* cited by examiner

CLEANING MITT

BACKGROUND OF THE INVENTION

There are a wide variety of cleaning devices out in the market. Some of those cleaning devices comprise cleaning mitts which may be used to clean surfaces of dirt, liquid, or other substances. Some of the existing cleaning mitts are made of materials, and/or configured in such a way, which may make it difficult for a user to clean intricate surfaces.

There is a need for cleaning mitts, and methods for their use, which will resolve one or more of the difficulties encountered with one or more of the existing cleaning mitts.

SUMMARY OF THE INVENTION

In one aspect of the invention, a mitt for cleaning comprises a microfiber material, a hand-receiving section, a separate thumb-receiving section, a separate index-finger receiving section, and a separate three-finger receiving section. The hand-receiving section is adapted to receive a hand. The separate thumb-receiving section is adapted to receive a thumb. The separate index-finger receiving section is adapted to receive an index-finger. The separate three-finger receiving section is adapted to receive a middle finger, a ring finger, and a pinky finger.

In another aspect of the invention, a mitt for cleaning comprises an elastic section, a hand-receiving section, a separate thumb-receiving section, a separate index-finger receiving section, and a separate three-finger receiving section. The elastic section is defined by an opening for insertion of a hand. The hand-receiving section is adapted to receive a hand. The separate thumb-receiving section is adapted to receive a thumb. The separate index-finger receiving section is adapted to receive an index-finger. The separate three-finger receiving section is adapted to receive a middle finger, a ring finger, and a pinky finger.

In a further aspect of the invention, a method for using a mitt to clean is disclosed. A microfiber mitt is provided which comprises a hand-receiving section, a separate thumb-receiving section, a separate index-finger receiving section, and a separate three-finger receiving section. A hand is inserted into the microfiber mitt. The mitt is utilized to clean a surface.

These and other features, aspects and advantages of the invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
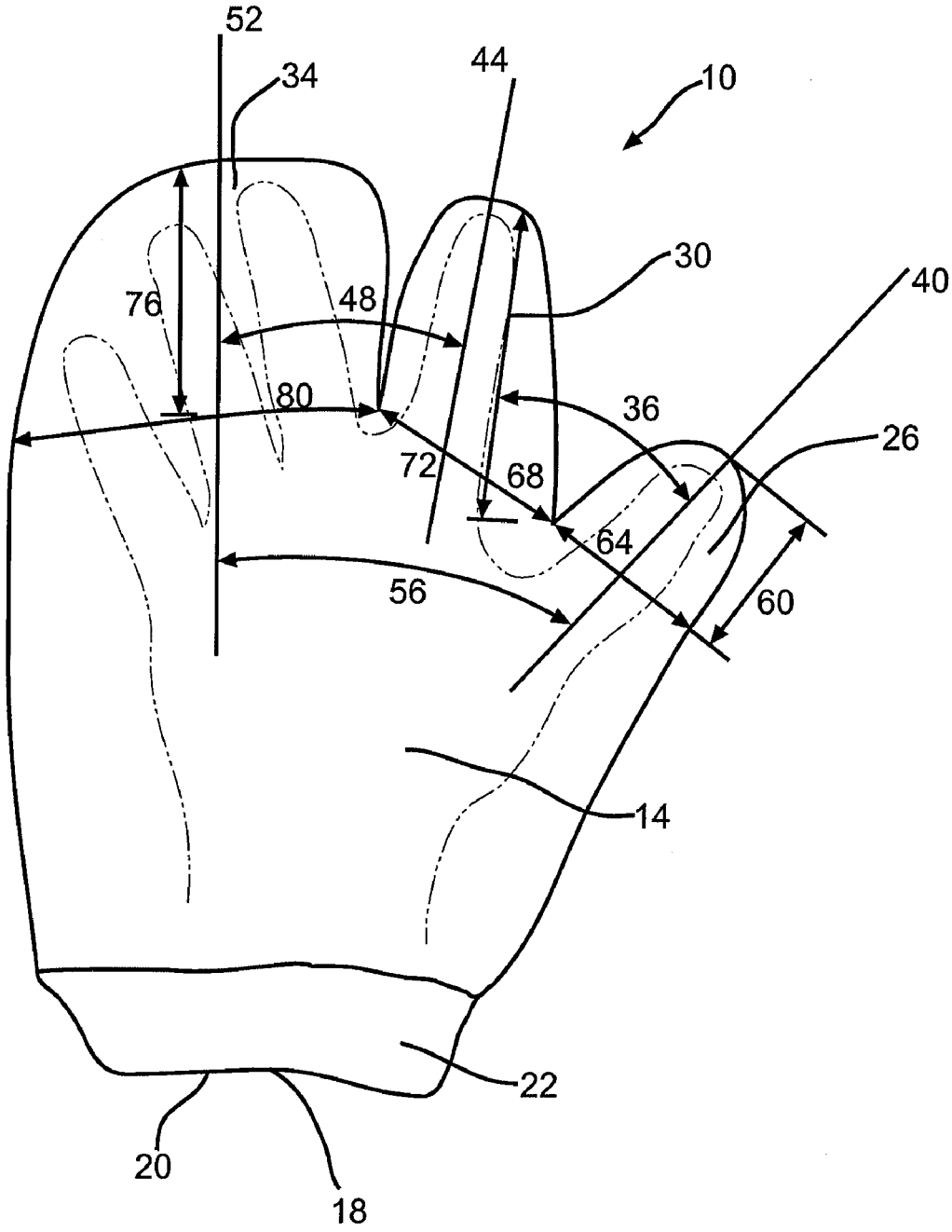
FIG. 1 is a front view of one embodiment of a cleaning mitt under the invention.

FIG. 1 depicts one embodiment under the invention of a mitt 10 for cleaning. The mitt 10 of the invention may allow for hands-on cleaning to avoid the use of a dusting tool, loose cloth, or other type of cleaning apparatus. The mitt 10 may be used for cleaning dust, dirt, hair, and other liquid and/or substances from various surfaces, such as hard-surfaces, tabletops, glass, stainless steel, wood, ceramics, plastics, windows, appliances, plants, knick-knacks, electronic equipment, animal hair, car surfaces, and other types of surfaces. Other uses of the mitt 10 may include polishing silverware, stemware, and other types of surfaces. The mitt 10 may be made of a microfiber material to allow a user to clean without chemicals. Both sides of the mitt 10 may be made of microfiber to allow the user to clean with the mitt 10 on either hand. The use of microfiber may allow the mitt 10 to be used for dusting when the mitt 10 is dry, and may allow the mitt 10 to be used for more aggressive cleaning when the mitt 10 is dampened with a liquid. In other embodiments, one or more of the opposing sides of the mitt 10 may be made of varying non-microfiber materials.

The mitt 10 may comprise a hand-receiving section 14 adapted to receive a hand of a user. An opening 18 in the mitt 10 may allow a user to insert a hand into the hand-receiving section 14. Upon insertion of a user's hand, the user's palm may rest within the hand-receiving section 14. The opening 18 may be defined in an elastic section 22 at an end 20 of the hand-receiving section 14 of the mitt 10. Upon insertion of a hand, the elastic section 22 may aid in conforming the mitt 10 around a user's hand. In other embodiments, differing configurations and/or materials may be used to conform the mitt 10 to a user's hand. In still other embodiments, the mitt 10 may be worn loosely around a user's hand without the aid of a conforming material.

A separate thumb-receiving section 26, a separate index-finger receiving section 30, and a separate three-finger receiving section 34 may be attached to and extended from the hand-receiving section 14. In other embodiments, various configurations may be used. Upon insertion of a user's hand into the hand-receiving section 14, the separate thumb-receiving section 26 may be adapted to receive the user's thumb, the separate index-finger receiving section 30 may be adapted to receive the user's index-finger, and the separate three-finger receiving section 34 may be adapted to receive the user's middle finger, ring finger, and pinky finger. Due to the flexibility of the various sections of the mitt 10, the hand-receiving section 14, the separate thumb-receiving section 26, the separate index-finger receiving section 30, and the separate three-finger receiving section 34 may be adapted to be in substantially the same plane and/or in substantially different planes when the mitt is in use.

The configuration and/or flexibility of the separate thumb-receiving section 26, separate index-finger receiving section 30, and separate three-finger receiving section 34 may allow a user to more easily and/or thoroughly clean due to the independent control the user may have over the user's thumb, index-finger, and remaining three-fingers. For instance, the configuration may allow a user to utilize an index finger to clean over, into, and/or around intricate areas of the objects being cleaned, such as over car dashboards, in vents and grates, over faucets, over CD and tape players, around knobs, between computer keyboard buttons, into vase openings, through moldings, into banister posts, and over various other objects. Moreover, due to the configuration of the mitt 10, it may be adapted to be worn on either hand of the user.

A first angle 36 between an axis 40 of the separate thumb-receiving section 26 and an axis 44 of the separate index-finger receiving section 30 may be in the range of thirty-two degrees to thirty-eight degrees. A second angle 48 between an axis 44 of the separate index-receiving receiving section 30 and an axis 52 of the separate three-finger receiving section 34 may be in the range of seven degrees to thirteen degrees. A third angle 56 between an axis 40 of the separate thumb-receiving receiving section 26 and an axis 52 of the separate three-finger receiving section 34 may be in the range of forty-two degrees to forty-eight degrees.

The length 60 of the separate thumb-receiving section 26 may range from 1.375 inches to 1.625 inches, while its width 64 may range from 1.75 inches to 2.0 inches. The length 68 of the separate index-receiving section 30 may range from 3.625 inches to 3.875 inches, while its width 72 may range from 2.0 inches to 2.25 inches. The length 76 of the separate three-finger receiving section 34 may range from 3.0 inches to 3.25 inches, while its width 80 may range from 3.75 inches to 4.0 inches. In other embodiments, the first, second, and third angles 36, 48, and 56, may be a varying number of degrees. In further embodiments, the lengths 60, 68, and 76, and the widths 64, 72, and 80 may be varying dimensions.

Figure 2:
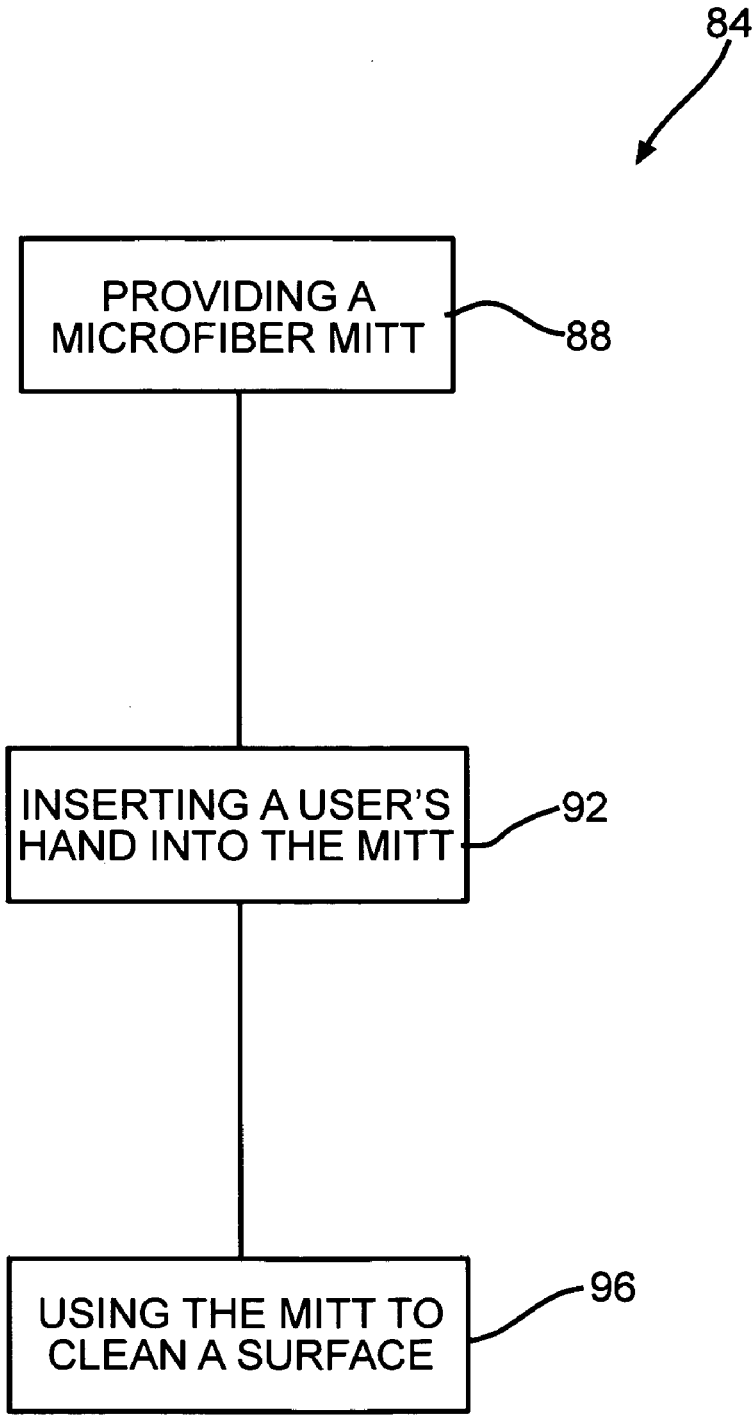
FIG. 2 depicts one embodiment of a method of using a mitt to clean under the invention.

FIG. 2 depicts one embodiment of a method 84 of using a mitt to clean under the invention. In step 88, a microfiber mitt may be provided. The provided microfiber mitt may comprise a hand-receiving section, a separate thumb-receiving section, a separate index-finger receiving section, and a separate three-finger receiving section. In step 92, a user's hand may be inserted into the provided microfiber mitt. During insertion of the user's hand, the user's hand may be inserted into the hand-receiving section, the user's thumb may be inserted into the thumb-receiving section, the user's index-finger may be inserted into the index-finger receiving section, and the user's other three fingers may be inserted into the three-finger receiving section. In step 96, the mitt may be used to clean a surface. The step 96 of cleaning a surface may comprise dusting the surface when the mitt is dry, and/or cleaning the surface when the mitt is damp. The user's index-finger may be used to clean intricate surfaces due to the flexibility and autonomy of the index-finger receiving section.

It should be understood, of course, that the foregoing relates to exemplary embodiments of the invention and that modifications may be made without departing from the spirit and scope of the invention as set forth in the following claims.

I claim:

1. A mitt for cleaning comprising:

a microfiber material;

a hand-receiving section adapted to receive a hand;

a separate thumb-receiving section adapted to receive a thumb;

a separate index-finger receiving section adapted to receive an index-finger; and a separate three-finger receiving section adapted to receive a middle finger, a ring finger, and a pinky finger, wherein a second angle between a center-line axis of the separate index-finger receiving section and a center-line axis of the separate three-finger receiving section is in the range of seven degrees to thirteen degrees.

2. The mitt of claim 1, wherein each of said separate thumb-receiving section, said separate index-finger receiving section, and said separate three-finger receiving section extend from said hand-receiving section.

3. The mitt of claim 1, wherein a first angle between a center-line axis of the separate thumb-receiving section and a center-line axis of the separate index-finger receiving section is in the range of thirty-two degrees to thirty-eight degrees.

4. The mitt of claim 1, wherein a third angle between a center-line axis of the separate thumb-receiving section and a center-line axis of the separate three-finger receiving section is in the range of forty-two degrees to forty-eight degrees.

5. The mitt of claim 1, wherein a first angle between a center-line axis of the separate thumb-receiving section and a center-line axis of the separate index-finger receiving section is approximately thirty-five degrees, a second angle between the center-line axis of the separate index-finger receiving section and a center-line axis of the separate three-finger receiving section is approximately ten degrees, and a third angle between the center-line axis of the separate thumb-receiving section and the center-line axis of the separate three-finger receiving section is approximately forty-five degrees.

6. The mitt of claim 1, wherein each of said hand-receiving section, said separate thumb-receiving section, said separate index-finger receiving section, and said separate three-finger receiving section are adapted to be in substantially the same plane.

7. The mitt of claim 6, wherein each of said separate thumb-receiving section, said separate index-finger receiving section, and said separate three-finger receiving section are adapted to be in substantially different planes.

8. The mitt of claim 1 further comprising an elastic section defined by an opening for insertion of a hand.

9. The mitt of claim 8, wherein said elastic section is at an end of said hand-receiving section.

10. The mitt of claim 1, wherein said hand-receiving section is adapted to cover the palm of a hand.

11. The mitt of claim 1, wherein said mitt is adapted to be worn on either a left or right hand.

12. The mitt of claim 1, wherein said mitt is adapted to dust when said mitt is dry, and said mitt is adapted to clean when said mitt is damp.

13. A mitt for cleaning comprising:

an elastic section defined by an opening for insertion of a hand;

a hand-receiving section adapted to receive a hand;

a separate thumb-receiving section adapted to receive a thumb;

a separate index-finger receiving section adapted to receive an index-finger; and a separate three-finger receiving section adapted to receive a middle finger, a ring finger, and a pinky finger, wherein a first angle between a center-line axis of the separate thumb-receiving section and a center-line axis of the separate index-finger receiving section is substantially in the range of thirty-two degrees to thirty-eight degrees, a second angle between the center-line axis of the separate index-receiving section and a center-line axis of the separate three-finger receiving section is substantially in the range of seven degrees to thirteen degrees, and a third angle between the center-line axis of the separate thumb-receiving section and the center-line axis of the separate three-finger receiving section is substantially in the range of forty-two degrees to forty-eight degrees.

14. The mitt of claim 13, wherein at least a portion of said mitt is made of microfiber.

15. The mitt of claim 13, wherein each of said separate thumb-receiving section, said separate index-finger receiving section, and said separate three-finger receiving section extend from said hand-receiving section.

16. The mitt of claim 13, wherein the first angle is approximately thirty-five degrees, the second angle is approximately ten degrees, and the third angle is approximately forty-five degrees.

17. The mitt of claim 13, wherein each of said hand-receiving section, said separate thumb-receiving section, said separate index-finger receiving section, and said separate three-finger receiving section are adapted to be in substantially the same plane.

18. The mitt of claim 17, wherein each of said separate thumb-receiving section, said separate index-finger receiving section, and said separate three-finger receiving section are adapted to be in substantially different planes.

19. The mitt of claim 13, wherein said elastic section is at an end of said hand-receiving section.

20. The mitt of claim 13, wherein said hand-receiving section is adapted to cover the palm of a hand.

21. The mitt of claim 13, wherein said mitt is adapted to be worn on either a left or right hand.

22. The mitt of claim 13, wherein said mitt is adapted to dust when said mitt is dry, and said mitt is adapted to clean when said mitt is damp.

23. A method for using a mitt to clean comprising:

providing a microfiber mitt comprising a hand-receiving section, a separate thumb-receiving section, a separate index-finger receiving section, and a separate three-finger receiving section, wherein said provided mitt further comprises a first angle between a center-line axis of the separate thumb-receiving section and a center-line axis of the separate index-finger receiving section in the range of thirty-two degrees to thirty-eight degrees, a second angle between the center-line axis of the separate index-finger receiving section and a center-line axis of the separate three-finger receiving section in the range of seven degrees to thirteen degrees, and a third angle between the center-line axis of the separate thumb-receiving section and the center-line axis of the separate three-finger receiving section in the range of forty-two degrees to forty-eight degrees;

inserting a hand into said microfiber mitt; and cleaning a surface using said mitt.

24. The method of claim 23, wherein said provided mitt further comprises an elastic section defined by an opening for insertion of a hand.

25. The method of claim 23, wherein the step of cleaning a surface using said mitt comprises at least one of dusting said surface when said mitt is dry and cleaning said surface when said mitt is damp.

26. The method of claim 23, wherein the step of cleaning a surface using said mitt comprises using the separate index-finger receiving section to clean said surface.

27. A mitt for cleaning comprising:

a microfiber material;

a hand-receiving section adapted to receive a hand;

a separate thumb-receiving section adapted to receive a thumb;

a separate index-finger receiving section adapted to receive an index-finger; and a separate three-finger receiving section adapted to receive a middle finger, a ring finger, and a pinky finger, wherein a third angle between a center-line axis of the separate thumb-receiving section and a center-line axis of the separate three-finger receiving section is in the range of forty-two degrees to forty-eight degrees.

28. The mitt of claim 27, wherein each of said separate thumb-receiving section, said separate index-finger receiving section, and said separate three-finger receiving section extend from said hand-receiving section.

29. The mitt of claim 27, wherein a first angle between a center-line axis of the separate thumb-receiving section and a center-line axis of the separate index-finger receiving section is in the range of thirty-two degrees to thirty-eight degrees.

30. The mitt of claim 27, wherein a second angle between a center-line axis of the separate index-finger receiving section and a center-line axis of the separate three-finger receiving section is in the range of seven degrees to thirteen degrees.

31. The mitt of claim 27, wherein a first angle between a center-line axis of the separate thumb-receiving section and a center-line axis of the separate index-finger receiving section is approximately thirty-five degrees, a second angle between the center-line axis of the separate index-finger receiving section and a center-line axis of the separate three-finger receiving section is approximately ten degrees, and a third angle between the center-line axis of the separate thumb-receiving section and the center-line axis of the separate three-finger receiving section is approximately forty-five degrees.

32. The mitt of claim 27, wherein each of said hand-receiving section, said separate thumb-receiving section, said separate index-finger receiving section, and said separate three-finger receiving section are adapted to be in substantially the same plane.

33. The mitt of claim 32, wherein each of said separate thumb-receiving section, said separate index-finger receiving section, and said separate three-finger receiving section are adapted to be in substantially different planes.

34. The mitt of claim 27 further comprising an elastic section defined by an opening for insertion of a hand.

35. The mitt of claim 34, wherein said elastic section is at an end of said hand-receiving section.

36. The mitt of claim 27, wherein said hand-receiving section is adapted to cover the palm of a hand.

37. The mitt of claim 27, wherein said mitt is adapted to be worn on either a left or right hand.

38. The mitt of claim 27, wherein said mitt is adapted to dust when said mitt is dry, and said mitt is adapted to clean when said mitt is damp.

39. A mitt for cleaning comprising:

a microfiber material;

a hand-receiving section adapted to receive a hand;

a separate thumb-receiving section adapted to receive a thumb;

a separate index-finger receiving section adapted to receive an index-finger; and a separate three-finger receiving section adapted to receive a middle finger, a ring finger, and a pinky finger, wherein a first angle between a center-line axis of the separate thumb-receiving section and a center-line axis of the separate index-finger receiving section is approximately thirty-five degrees, a second angle between the center-line axis of the separate index-finger receiving section and a center-line axis of the separate three-finger receiving section is approximately ten degrees, and a third angle between the center-line axis of the separate thumb-receiving section and the center-line axis of the separate three-finger receiving section is approximately forty-five degrees.

40. The mitt of claim 39, wherein each of said separate thumb-receiving section, said separate index-finger receiving section, and said separate three-finger receiving section extend from said hand-receiving section.

41. The mitt of claim 39, wherein a first angle between a center-line axis of the separate thumb-receiving section and a center-line axis of the separate index-finger receiving section is in the range of thirty-two degrees to thirty-eight degrees.

42. The mitt of claim 39, wherein a second angle between a center-line axis of the separate index-finger receiving section and a center-line axis of the separate three-finger receiving section is in the range of seven degrees to thirteen degrees.

43. The mitt of claim 39, wherein a third angle between a center-line axis of the separate thumb-receiving section and a center-line axis of the separate three-finger receiving section is in the range of forty-two degrees to forty-eight degrees.

44. The mitt of claim 39, wherein each of said hand-receiving section, said separate thumb-receiving section, said separate index-finger receiving section, and said separate three-finger receiving section are adapted to be in substantially the same plane.

45. The mitt of claim 44, wherein each of said separate thumb-receiving section, said separate index-finger receiving section, and said separate three-finger receiving section are adapted to be in substantially different planes.

46. The mitt of claim 39 further comprising an elastic section defined by an opening for insertion of a hand.

47. The mitt of claim 46, wherein said elastic section is at an end of said hand-receiving section.

48. The mitt of claim 39, wherein said hand-receiving section is adapted to cover the palm of a hand.

49. The mitt of claim 39, wherein said mitt is adapted to be worn on either a left or right hand.

50. The mitt of claim 39, wherein said mitt is adapted to dust when said mitt is dry, and said mitt is adapted to clean when said mitt is damp.

* * * * *